United States Patent [19]

Drucker

[11] Patent Number: 4,478,055

[45] Date of Patent: Oct. 23, 1984

[54] METHOD AND APPARATUS FOR IMPROVING HEAT PUMP PERFORMANCE BY CONTROLLING DISCHARGE OF INDOOR FAN THERMAL ENERGY

[75] Inventor: Alan S. Drucker, Dewitt, N.Y.

[73] Assignee: Carrier Corporation, Syracuse, N.Y.

[21] Appl. No.: 427,382

[22] Filed: Sep. 29, 1982

[51] Int. Cl.[3] ..... F25B 13/00

[52] U.S. Cl. ..... 62/324.1; 417/366

[58] Field of Search ..... 417/366, 360, 372; 310/62, 63; 62/324.1, 325

[56] References Cited

U.S. PATENT DOCUMENTS

| | | | |
|---|---|---|---|
| 2,908,147 | 10/1959 | Powers . | |
| 2,978,881 | 4/1961 | Alsing | 62/324.1 X |
| 3,108,452 | 10/1963 | Breen . | |
| 3,199,774 | 8/1965 | Lowell | 310/63 X |
| 3,671,714 | 6/1972 | Charns | 310/62 X |
| 3,718,281 | 2/1973 | Beatenbough et al. | 236/13 X |
| 4,206,611 | 6/1980 | Lang et al. . | |
| 4,236,443 | 12/1980 | Schossow | 417/366 X |

*Primary Examiner*—William E. Tapolcai

*Attorney, Agent, or Firm*—David J. Zobkiw

[57] ABSTRACT

A method and apparatus for achieving efficient utilization of the thermal energy generated by the indoor fan motor of an indoor unit of a reverse cycle air conditioning system is disclosed. A method is provided for dissipating the thermal energy of the fan motor to the indoor air stream when the heat exchanger is in the heating mode of operation and for dissipating such thermal energy to a heat sink when the indoor unit is operated in the cooling mode of operation such that the fan energy may either be added to the amount of heat energy being supplied to the enclosure or may be dissipated outside the enclosure such that it is not added to the cooling load of the enclosure when the system is operated in the cooling mode.

5 Claims, 4 Drawing Figures

METHOD AND APPARATUS FOR IMPROVING HEAT PUMP PERFORMANCE BY CONTROLLING DISCHARGE OF INDOOR FAN THERMAL ENERGY

BACKGROUND OF THE INVENTION

1. Field of the Invention

This invention generally relates to heat exchange units and more particularly to an indoor unit of a heat pump including apparatus for controlling air flow in heat exchange relation with the fan motor used to power an indoor fan included as part of the indoor unit.

2. Prior Art

A typical reverse cycle or heat pump air conditioning unit includes a refrigeration circuit having indoor and outdoor heat exchangers as well as a compressor and an expansion device. A reversing valve is provided to direct the flow of refrigerant either directly to the indoor heat exchanger when the unit is operated to provide heating or to the outdoor heat exchanger when it is operated to provide cooling. The refrigeration circuit acts to exchange heat energy between air flowing through the indoor unit, typically, the air being returned to the space to be conditioned and the outdoor ambient in heat exchange relation with the outdoor unit. Hence, thermal energy is transferred between outdoor ambient air and the indoor space based upon the mode of operation of the air conditioning system.

The typical indoor unit for use in a heat pump system includes a heat exchanger serving as the indoor heat exchanger. This heat exchanger is a condenser when the unit is operated in the heating mode discharging thermal energy and an evaporator when the unit is operated in the cooling mode absorbing thermal energy. The typical indoor unit additionally includes a fan for circulating air between the space to be conditioned and the indoor heat exchanger. Conventionally the heat exchanger is mounted within a casing which is connected by duct work to the appropriate portions of the space to be conditioned.

In prior art heat pump systems, the indoor fan motor for powering the indoor fan is located within the casing defining the indoor unit and located within the air flow stream of the air flowing through the unit to the space to be conditioned. During operation the indoor fan motor converts electrical energy into mechanical energy for circulating the air and into thermal energy. This thermal energy is given up to the air flowing in heat exchange relation with the motor adding to the heating capability of the system.

When the heat pump is operated in the cooling mode of operation the thermal energy of the fan is additionally dissipated into the indoor air stream adding to the overall cooling load on the unit. Prior art cooling only devices have avoided this problem by locating the fan motor external to the air stream such that the thermal energy created by operation of the motor is dissipated to a separate heat sink from the air being circulated to the enclosure.

The present arrangement concerns the altering of the indoor air flow path such that heat energy generated by the fan motor is absorbed by the indoor air when the heat pump is operated in the heating mode and is discharged to a separate heat sink when the heat pump is operated in the cooling mode. Hence, the energy utilized by the fan motor which is converted to thermal energy is utilized to increase the heating capability of the unit when it is operating in the heating mode and is dissipated outside the indoor air flow stream to not add to the cooling load when the unit is in the cooling mode of operation. Specific apparatus is disclosed herein for effecting a change in the indoor air flow path to obtain appropriate utilization of the thermal energy generated by the indoor fan motor. As set forth herein, the indoor fan motor is mounted on a bracket extending partially within the casing defining the indoor unit. Air flow through the indoor unit flows in heat exchange relation with the motor unless a cover is placed about the bracket preventing air flow to the motor. An additional enclosure is provided for covering the exterior of the motor when the unit is operating in the heating mode such that thermal energy from the motor is not transferred to air outside the casing. When the unit is operated in the cooling mode the motor bracket is covered such that indoor air is not in heat exchange relation with the motor and the enclosure covering the portion of the motor extending outside is removed such that heat energy from the motor is dissipated to the heat sink surrounding the indoor unit. This heat sink may typically be the air of the basement or an enclosure, garage, attic or some other space where added heat energy during the cooling mode is not a significant factor to the homeowner.

SUMMARY OF THE INVENTION

It is an object of the present invention to provide an improved heat pump system.

It is a further object of the present invention to provide a method of improving the overall performance of a heat pump system.

It is a yet further object of the present invention to provide apparatus for routing indoor air in heat exchange relation with the indoor fan motor when a heat pump unit is operated in the heating mode.

It is a further object of the present invention to provide apparatus and a method for dissipating heat energy from the fan motor to air external to the indoor unit when the heat pump is operated in the cooling mode.

It is a further object of the present invention to provide a safe, economical and reliable method of switching between air flow paths for cooling the fan motor when the unit is changed over between the heating and cooling modes of operation.

It is another object of the present invention to provide a safe, economical, reliable and easy to manufacture indoor unit for use with a heat pump.

Other objects will be apparent from the description to follow and the appended claims.

These and other objects are achieved in accordance with the preferred embodiment of the present invention wherein there is provided an air conditioning system for heating and cooling a space including a refrigeration circuit having an indoor heat exchanger, an outdoor heat exchanger and a compressor. Said indoor heat exchanger is mounted within a casing defining a portion of an air flow path of the space to be conditioned and a fan for circulating air to the enclosure. The air conditioning system further includes a fan motor connected to power the fan to circulate air between the indoor heat exchanger and the space to be conditioned, control means for selectively operating the refrigeration circuit to either absorb thermal energy at the indoor heat exchanger from the air circulated to the space to be conditioned when cooling is desired or for discharging thermal energy to the air circulated to the space to be conditioned from the indoor heat exchanger when heating is desired and air flow routing means for routing the air circulated to the space in heat exchange relation with the fan motor when heating is desired and for routing the air circulated to the space to bypass the fan motor when cooling is desired. The air flow routing means may additionally include a motor bracket extending parallel to the casing, said motor bracket including means for securing the fan motor thereto, said motor bracket and casing defining an air flow path therebetween and a cover assembly sized to fit over the motor bracket to prevent the flow of air along the air flow path defined between the casing and the motor bracket. Additionally, an enclosure may be provided for covering the exterior fan motor to prevent cooling of the fan motor by air exterior to the casing.

A method of operating an air conditioning system including a reversible refrigeration circuit for transferring thermal energy between the space to be conditioned and a separate region including a fan for circulating air to the space to be conditioned and an electric motor for powering the fan is further disclosed. The method of operation includes selectively operating the refrigeration circuit to either absorb thermal energy from the space to be conditioned or to discharge thermal energy to the space to be conditioned, energizing the fan motor to power the fan to effect circulation of the air to the enclosure, routing the air circulated by the step of energizing in heat exchange relation with the fan motor when the step of operating is discharging thermal energy to the enclosure and preventing the step of routing when the step of operating is absorbing thermal energy from the space to be conditioned.

DESCRIPTION OF THE PREFERRED EMBODIMENT

Figure 1:
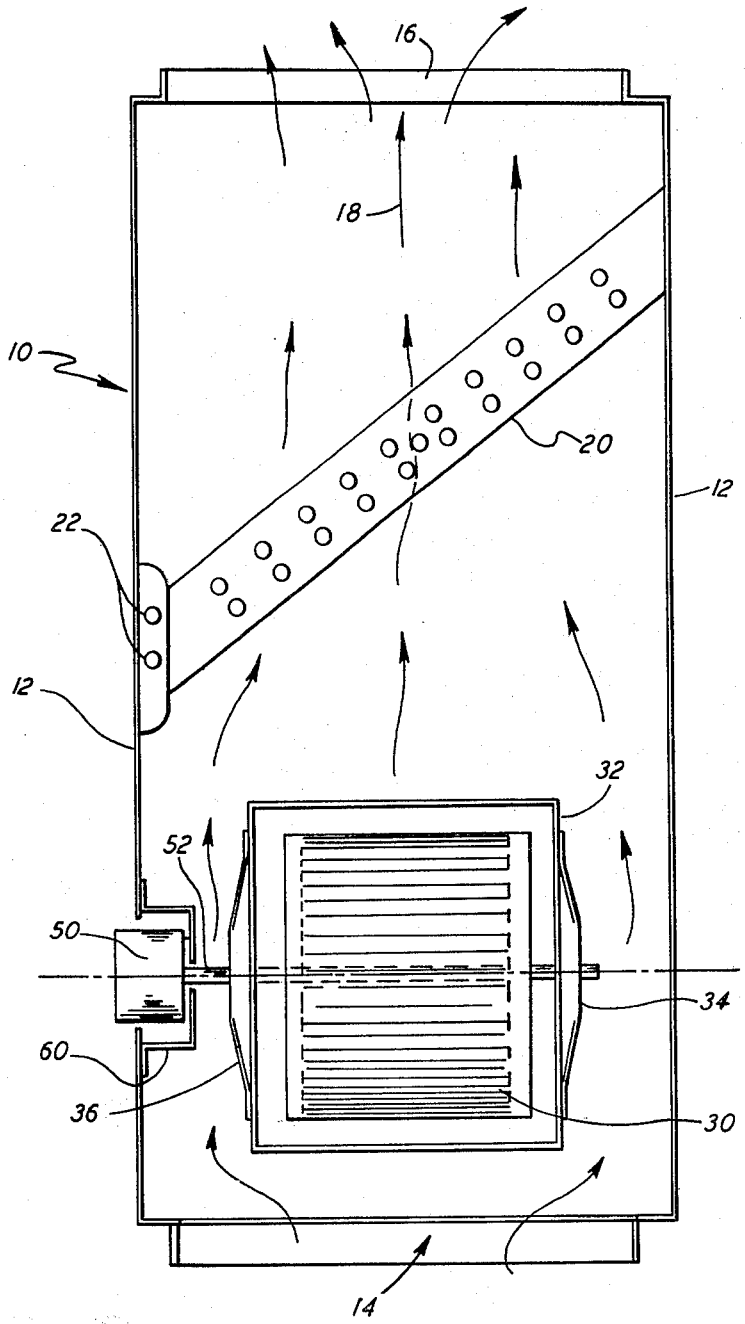
FIG. 1 is a side view of the indoor section of an air conditioning unit.

The embodiment hereinafter described will refer to an indoor heat exchange unit as is adapted to be mounted as a portion of a residential air conditioning system. It is to be understood that this heat exchange unit may be mounted in combination with a furnace or separate heating means or may be utilized alone to supply the appropriate heating and cooling to the enclosure. It is further to be understood that the indoor unit need not be mounted within the enclosure but may be mounted in the space adjacent the enclosure, on the roof, on the ground next to the enclosure or some other location wherein there is an indoor air flow path between the indoor heat exchanger and fan and the enclosure.

Additionally, as set forth herein the fan motor is arranged such that heat energy generated within the fan motor is dissipated to the air external of the unit casing when the heat pump is operated in the cooling mode. It is to be understood for this purpose that the fan motor may be located either in the outdoor ambient, basement, attic or some other location wherein the heat energy generated by the fan may be dissipated to the air without substantially effecting the cooling load on the enclosure.

It is additionally to be understood that although a specific structure is set forth herein for mounting the motor such that the motor extends partially within and partially without the casing that not only will other structures serve the same purpose for mounting the motor in this arrangement but that the motor may equally be mounted entirely within or entirely without the casing and the appropriate air flow directed to achieve the same purpose. In other words, the fan motor may be mounted entirely within the casing and under those conditions when fan motor thermal energy is desired to be dissipated outside the casing air flow from outside the casing is directed within a subenclosure containing the fan motor. An integrally built fan within the motor may be utilized for circulating air for such purpose. The opposite situation would be the location of the fan motor entirely outside the casing and the direction of indoor air to a subenclosure outside the casing containing the fan motor such that the fan motor would be appropriately in heat exchange relation with the indoor air in the heating mode of operation.

It may additionally be within the scope of the present invention to provide apparatus for automatically switching the air flow within the indoor unit to achieve the purpose of the present invention of utilizing the fan thermal energy when it may add to the overall heating energy provided and to dissipate that energy to a sink where it is not desirable to add to the cooling load such that when the heat pump is reversed from the heating to cooling modes the air flow is automatically directed to the appropriate mode. A solenoid, damper, motor or other similar apparatus could be utilized to achieve such a result. Numerous methods of blocking potential air flow could be utilized to mesh with an automatic switching device to appropriately direct the air flow without requiring the addition of covers and enclosures as set forth herein.

Referring now to FIG. 1 there may be seen a view of indoor unit 10 including an indoor heat exchanger 20, casing 12, fan 30 and indoor fan motor 50. The fan 30 is mounted on shaft 52 supported by bearings 36 and 34 and located within fan scroll 32 for directing air upwardly through the indoor unit. Arrows 18 show the direction of air flow through the unit with the air entering through entry opening 14, flowing into the fan and being discharged upwardly therefrom through indoor heat exchanger 20 and out discharge opening 16. Indoor heat exchanger 20 is shown mounted diagonally across the air flow stream and has refrigerant connections 22 for connecting liquid and vapor refrigerant lines to the heat exchanger. Indoor fan motor 50 is shown mounted partially within the casing and partially exterior of the casing. Motor bracket 60 is provided for the support of the fan motor 50.

Figure 2:
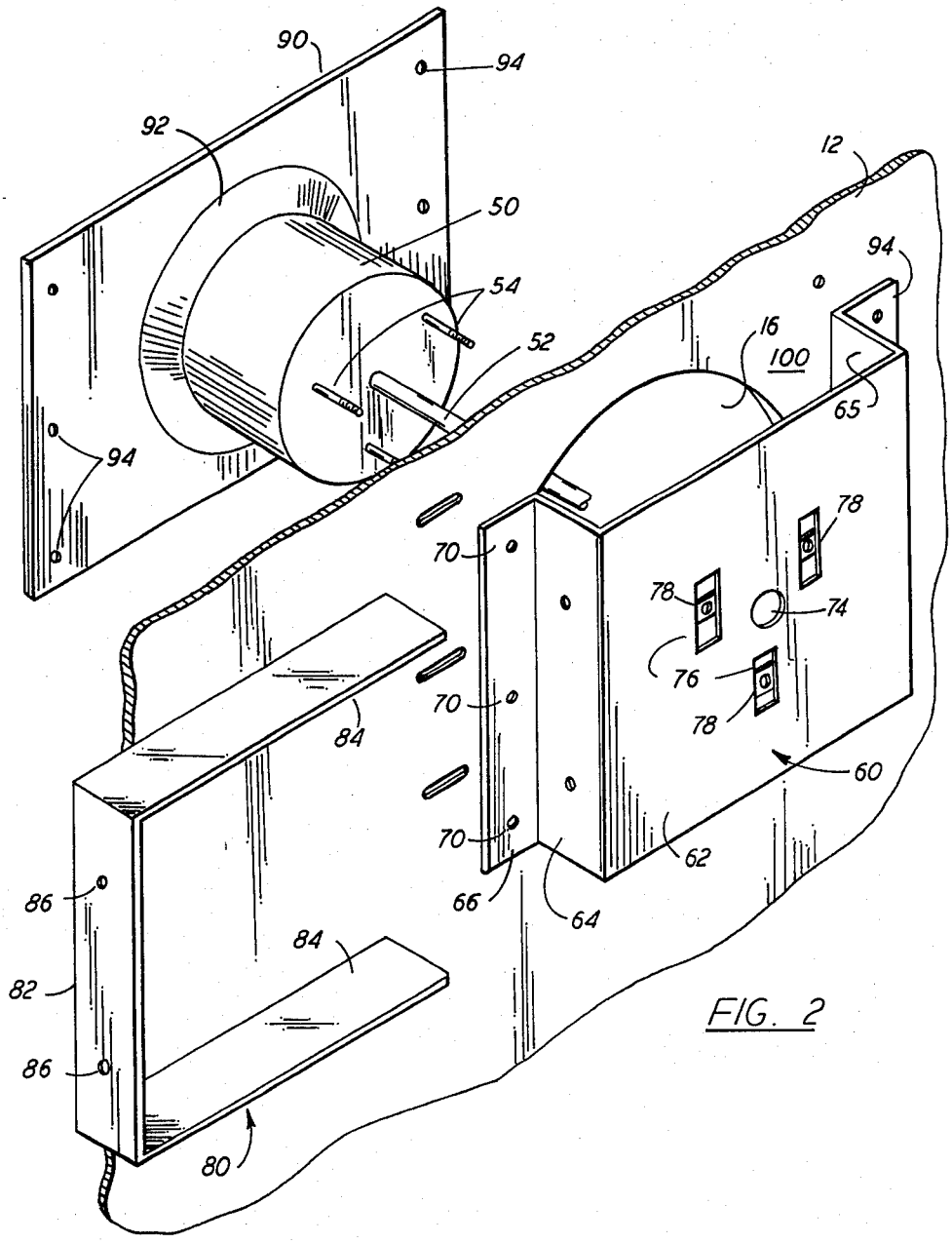
FIG. 2 is an exploded view of the fan motor mounting arrangement.

Referring now to FIG. 2 there may be seen an exploded view of the fan support arrangement. Motor 50 is a typical cylindrical fan motor having bolts 54 extending from the end thereof as well as shaft 52 to which the fan may be mounted. Motor bracket 60 has a support portion 62, leg portions 64 and 65 perpendicular to support portion 62 and flange portions 66 and 68 connected respectively to leg portions 64 and 65 for securing the motor bracket to casing 12. Leg portions 64 and 65 act to space the support portion 62 of the motor bracket from casing 12 such that an air flow passageway 100 is defined between the casing and motor bracket. It is within this air flow passageway that at least a portion of motor 50 is mounted.

Support portion 62 of the motor bracket additionally defines shaft opening 74 through which shaft 52 of the motor may extend and three support openings 76 each having a slidable nut 78 which slides vertically within the slot. The three nuts 78 coact with bolts 54 to secure the motor in position. The sliding of the nuts together with the sliding of the entire motor bracket in its engagement with casing 12 acts to allow the fan motor to be aligned with the fan. Additionally, leg openings within leg portion 64 are designed for the receipt of fasteners. Flange openings 70 within flange portion 66 are designed for the receipt of the fasteners to secure the motor bracket to the casing.

Cover 80 is shown as a U-shaped member having back portion 82 and two blocking portions 84 extending perpendicularly from back portion 82. Cover openings 86 are arranged in the back portion and are in registration with leg openings 72 such that upon assembly the cover may be slid in engagement with motor bracket 60 such that air flow passageway 100 may be covered by the blocking portions 84 of cover 80 to prevent air flow through passageway 100 in heat exchange relation with the fan motor.

Additionally shown in FIG. 2 is closure 90 including a flat plate defining an indentation 92. Closure 90 is arranged such that it may be secured to casing 12 with a portion of the fan motor extending into indentation 92. Closure openings 94 are provided for fasteners to secure the closure to the casing.

Figure 3:
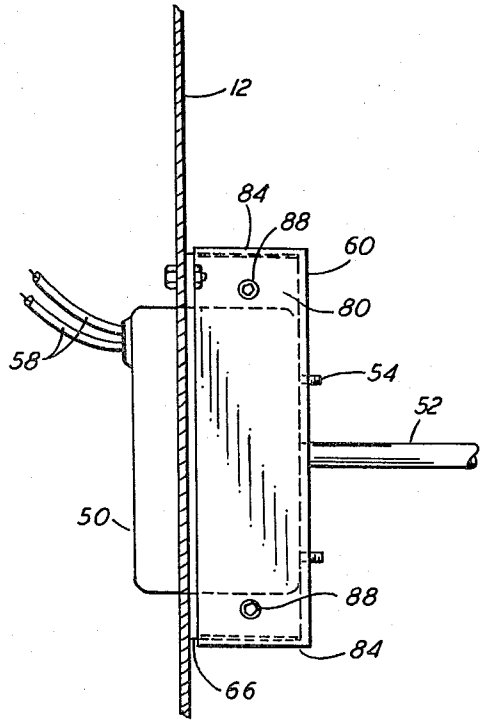
FIG. 3 is a side view of the fan motor mounted to discharge heat energy to air external of the casing.

FIG. 3 shows the fan motor secured to motor bracket 60 in a position such that thermal energy generated by the fan motor is dissipated to air external to casing 12 as it would be if the unit is operated in the cooling mode. As shown in FIG. 3, motor bracket 60 is secured to casing 12. Bolts 54 are engaged to the motor bracket to secure fan motor 50 thereto with fan motor shaft 52 extending therethrough to engage the fan. Cover 80 is shown secured with cover bolts 88 to motor bracket 60 such that blocking portions 84 of the cover extend across the top and bottom of motor bracket covering the air flow passageway such that the casing 12, motor bracket 60 and cover 80 define an enclosure within the casing preventing indoor air from flowing in heat exchange relation with the fan motor. It may additionally be seen in FIG. 3 that a portion of the fan motor extends externally from the unit and is that portion to the left of casing 12. Motor leads 58 are shown for making the appropriate electrical connections to the motor. In the cooling mode of operation it is this portion of the fan motor that is in heat exchange relation with air external to the casing and which air acts to absorb thermal energy from the fan motor to effect cooling thereof.

Figure 4:
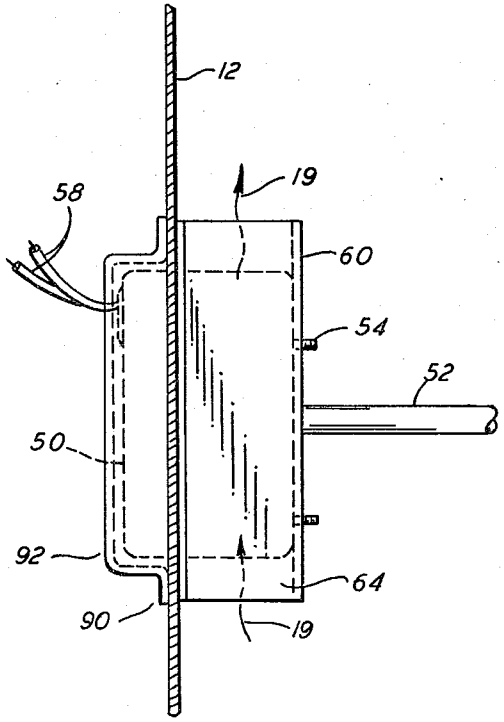
FIG. 4 is a side view of the fan motor mounted to discharge heat energy to the indoor air being circulated through the casing.

FIG. 4 is an identical view to FIG. 3 with the fan support arrangement shown in position for the heating mode of operation. Motor bracket 60 is mounted to casing 12 and supports fan motor 50 via bolts 54. Fan shaft 52 extends through motor bracket 60 for powering the fan. Leg portion 64 and flange portion 66 may additionally be seen. There is no cover provided in this figure and air flow as indicated by arrows 19 is allowed upwardly through the bottom of the space created between the motor bracket and the casing in heat exchange relation with the fan motor. Arrows 19 are shown for indicating this air flow.

External to casing 12 is shown closure 90 including indentation portion 92 for covering the portion of the fan motor extending exterior to casing 12. Closure 90 prevents thermal transfer between the fan motor and the air external to the enclosure such that the thermal energy generated by the fan is dissipated to the indoor air flow stream in heat exchange relation with the fan motor.

Hence, it may be seen from the above figures that when the unit is operated in the heating mode of operation the indoor air flow stream is placed in heat exchange relation with the fan motor such that the thermal energy generated by the fan is added to the indoor air. The cooling mode position is shown in FIG. 3 wherein the heat energy supplied to the fan motor is dissipated to air external to casing 12 such that the fan thermal energy is not added to the indoor fan air stream and hence is not added to the overall cooling load of the enclosure. By appropriately directing the fan motor thermal energy the performance of the heat pump is improved.

The herein invention has been described with reference to a particular embodiment. It is to be understood by those skilled in the art that various changes and modifications may be made and equivalents substituted for the elements thereof without departing from the scope of the invention.

What is claimed is:

1. A method of operating an air conditioning system including a reversible refrigeration circuit for transferring thermal energy between the space to be conditioned and a separate region including an indoor coil mounted within a casing, a fan for circulating air to the space to be conditioned in heat exchange relation with the indoor coil and an electric motor for powering the fan which comprises the steps of:

mounting the fan motor at least partially within the flow path of the air circulating through the heat exchanger;

selectively operating the refrigeration circuit to either absorb thermal energy from the space to be conditioned or to discharge thermal energy to the space to be conditioned;

energizing the fan motor to power the fan to effect circulation of air to the enclosure;

routing the air circulated by the step of energizing in heat exchange relation with the fan motor when the step of operating is discharging thermal energy to the enclosure; and preventing the step of routing when the step of operating is absorbing thermal energy from the space to be conditioned and blocking air flow to that portion of the casing wherein the motor is mounted and cooling the motor by heat exchange between the motor and air exterior to the casing.

2. The method as set forth in claim 1 wherein the step of routing comprises not blocking the air flow path within the casing to the motor and reducing the flow of air exterior of the casing to the motor such that the motor is cooled by air flowing within the casing.

3. An air conditioning system for heating and cooling a space including a refrigeration circuit having an indoor heat exchanger, an outdoor heat exchanger and a compressor, said indoor heat exchanger being mounted within a casing defining a portion of an air flow path to the space to be conditioned and a fan for circulating air to the enclosure which comprises:

a fan motor mounted at least partially within the casing within the air flow path of the air circulated to the space to be conditioned and connected to power the fan to circulate air between the indoor heat exchanger and the space to be conditioned;

control means for selectively operating the refrigeration circuit to either absorb thermal energy at the indoor heat exchanger from the air circulated to the space to be conditioned when cooling is desired or for discharging thermal energy to the air circulated to the space to be conditioned from the indoor heat exchanger when heating is desired;

air flow routing means for routing the air circulated to the space in heat exchange relation with the fan motor absorbing thermal energy therefrom when heating is desired and for routing the air circulated to the space to bypass the fan motor when cooling is desired; and a cover means for encasing the fan motor within the casing to divert the air flow within the casing to substantially reduce the transfer of thermal energy from the fan motor to the air circulated to the space to be conditioned when cooling is desired.

4. The apparatus as set forth in claim 3 and further comprising:

a motor bracket extending from and parallel to the casing, said motor bracket including means for securing the fan motor thereto and said motor bracket and casing defining an air flow path therebetween; and a cover assembly sized to fit over the motor bracket to prevent the flow of air along the air flow path defined between the casing and the motor bracket.

5. An air conditioning system for heating and cooling a space including a refrigeration circuit having an indoor heat exchanger, an outdoor heat exchanger and a compressor, said indoor heat exchanger being mounted within a casing defining a portion of an air flow path to the space to be conditioned and a fan for circulating air to the enclosure which comprises:

a fan motor mounted at least partially within the casing within the air flow path of the air circulated to the space to be conditioned and connected to power the fan to circulate air between the indoor heat exchanger and the space to be conditioned such that a portion of the fan motor extends exterior to the casing and further comprising a closure which is placed over the fan motor when heating is desired to reduce cooling of the fan motor by air exterior to the casing and which enclosure is removed when cooling is desired to allow cooling of the fan motor by air exterior to the casing;

control means for selectively operating the refrigeration circuit to either absorb thermal energy at the indoor heat exchanger from the air circulated to the space to be conditioned when cooling is desired or for discharging thermal energy to the air circulated to the space to be conditioned from the indoor heat exchanger when heating is desired; and air flow routing means for routing the air circulated to the space in heat exchanger relation with the fan motor absorbing thermal energy therefrom when heating is desired and for routing the air circulated to the space to bypass the fan motor when cooling is desired.

* * * * *